US011053733B2

(12) United States Patent
Montanaro

(10) Patent No.: US 11,053,733 B2
(45) Date of Patent: Jul. 6, 2021

(54) SYSTEM COMPRISING A SLIDING SHIELD AND A GUIDING AND TENSIONING RETRACTABLE DEVICE FOR THE SLIDING SHIELD

(71) Applicant: MV LINE S.p.A., Acquaviva delle Fonti (IT)

(72) Inventor: Paolo Montanaro, Casamassima (IT)

(73) Assignee: MV LINE S.p.A., Acquaviva delle Fonti (IT)

( * ) Notice: Subject to any disclaimer, the term of this patent is extended or adjusted under 35 U.S.C. 154(b) by 244 days.

(21) Appl. No.: 16/099,273

(22) PCT Filed: Apr. 27, 2017

(86) PCT No.: PCT/IB2017/052435
§ 371 (c)(1),
(2) Date: Nov. 6, 2018

(87) PCT Pub. No.: WO2017/195061
PCT Pub. Date: Nov. 16, 2017

(65) Prior Publication Data

US 2019/0145165 A1 May 16, 2019

(30) Foreign Application Priority Data

May 11, 2016 (IT) ..... 102016000048201

(51) Int. Cl.
*E06B 9/54* (2006.01)
*E06B 9/58* (2006.01)

(52) U.S. Cl.
CPC ..... *E06B 9/54* (2013.01); *E06B 9/58* (2013.01); *E06B 2009/543* (2013.01)

(58) Field of Classification Search
CPC ..... E06B 9/54; E06B 9/58; E06B 2009/543; E06B 9/581

(Continued)

(56) References Cited

U.S. PATENT DOCUMENTS 6,318,438 B1 * 11/2001 Uno ..... E06B 9/262 160/194
7,222,655 B2 * 5/2007 Toti ..... E06B 9/262 160/89

(Continued)

FOREIGN PATENT DOCUMENTS

EP 0790384 A1 * 8/1997 ..... E06B 9/54
EP 2312113 A1 4/2011

(Continued)

OTHER PUBLICATIONS

International Search Report and Written Opinion issued in PCT/162017/052435, dated Aug. 10, 2017; ISA/EP.

*Primary Examiner* — Johnnie A. Shablack
*Assistant Examiner* — Abe Massad
(74) *Attorney, Agent, or Firm* — Harness, Dickey & Pierce, P.L.C.

(57) ABSTRACT

A system comprising:

a sliding shield equipped with horizontally sliding cloth movable by means of a handle bar between a lateral box and a closure upright, and a guiding and tensioning retractable device for sliding shields comprising a plurality of first guiding modules and a plurality of second guiding modules, consecutively and alternately coupled between them forming a guiding body foldable and insertable within the handle bar and comprising a first terminal end fixable to the lateral box and a second terminal end adapted to be free of sliding within the handle bar, the first guiding modules and the second guiding modules being interposable between the handle bar and the lateral box.

The sliding shield comprises at least a lower pocket and the guiding and tensioning retractable device comprises at least (Continued)

a tensioning element provided with a first end anchored to the second terminal end and a second free end inserted within the lower pocket.

5 Claims, 7 Drawing Sheets

(58) Field of Classification Search
USPC ..... 160/84.06
See application file for complete search history.

(56) References Cited

U.S. PATENT DOCUMENTS 7,395,850 B2 * 7/2008 Chino ..... E06B 9/54 160/243
7,472,738 B2 * 1/2009 Kamosawa ..... E06B 9/52 160/243
7,673,666 B2 * 3/2010 Fan ..... E06B 9/262 160/84.04
7,717,152 B2 * 5/2010 Moriya ..... E06B 9/54 160/31
7,810,542 B2 * 10/2010 Bonini ..... E06B 9/54 160/31
8,196,638 B2 * 6/2012 Roberts ..... E06B 9/54 160/84.06
8,316,913 B2 * 11/2012 Chino ..... E06B 9/52 160/194
8,887,789 B2 * 11/2014 Tremaine, III ..... E06B 9/0692 160/273.1
2009/0266495 A1 * 10/2009 Karasawa ..... E06B 9/262 160/84.03
2010/0252210 A1 10/2010 Roberts et al.
2014/0299279 A1 * 10/2014 Montanaro ..... E06B 9/54 160/89
2015/0204137 A1 * 7/2015 Montanaro ..... E06B 9/58 160/84.02

FOREIGN PATENT DOCUMENTS

EP 2400105 A1 12/2011
EP 2407628 A2 * 1/2012 ..... E06B 9/582
EP 2487317 A1 8/2012
EP 2775088 A1 * 9/2014 ..... E06B 9/54
EP 2681393 B1 * 3/2015 ..... E06B 9/522
WO WO-2013015689 A1 1/2013

* cited by examiner

SYSTEM COMPRISING A SLIDING SHIELD AND A GUIDING AND TENSIONING RETRACTABLE DEVICE FOR THE SLIDING SHIELD

CROSS-REFERENCE TO RELATED APPLICATIONS

This application is a U.S. National Phase Applications under 35 U.S.C. 371 of International Application No. PCT/IB2017/052435, filed on Apr. 27, 2017, and published in English as WO 2017/195061 A1 on Nov. 16, 2017, which claims priority to Italian Patent Application No. 102016000048201, filed on May 11, 2016. The entire disclosures of the above applications are incorporated herein by reference.

FIELD

The present invention relates to a system comprising a sliding shield and a guiding and tensioning retractable device for the sliding shield.

BACKGROUND

This section provides background information related to the present disclosure which is not necessarily prior art.

As it is known, mobile foldable guides are present in the scrolling shields to ensure a greater stability during the opening and closing operations. Such shields, being mosquito nets or curtains, are installed within a compartment of a wall and are constituted mainly by: a shield attached at one end to a winding lateral box and at the other end to a handle bar; a fixed upper guide; a fixed lower guide; a closure upright; and a lower folding mobile guide, sliding on the lower fixed guide and insertable in the handle bar.

The lower movable guide, being arranged on the fixed lower guide between the lateral box and the handle bar, serves as the stiffening element when the shield is open. In fact, during the opening of the shield, the lower movable guide passes from the rest position inside the handle bar to the active position in which it is stretched on the lower fixed guide, thus ensuring greater stability of the shield under the effect of destabilizing actions, as well as protection from damage in the event of external stress.

Conversely, in the closing phase, the insertion of the lower movable guide in the handle bar ensures a small footprint.

A first known solution is described in the patent EP2312113, concerning an anti-mosquito roller screen which is horizontally slidable. The arrangement has a movable vertical stile which is connected to an upper horizontal rail and comprises the handle. Inside the stile a flexible chain is housed which is inserted or retracted when closing or opening the screen and which serves as the lower frame part of the screen. In particular, the application describes the arrangement and pre-tensioning of the cable which is invisibly housed in the frame parts and connects the chain to the screen roller.

A second known solution is described in the patent application WO 2013/015689, disclosing a retractable and extendable covering device for architectural openings, which includes first and second substantially parallel posts, a retractable and extendable substantially rectangular screen member, and a first flexible guide member. The first flexible guide member is deflected into one of the first and second posts and slidably receivable therein. Each of the parallel posts has a hollow interior, and at least one of the first and second posts being movable toward and away with respect to the other. The retractable and extendable screen member has first and second pairs of opposite parallel edges and is mounted between the first and second parallel posts at its first pair of parallel edges. The first flexible guide member extends along one edge of the second pair of parallel edges of the screen member and between the first and second posts for retaining the one edge of the screen member. The first and second parallel posts each include a base profile part and an auxiliary profile part defining the hollow interior there between for slidably receiving the first flexible guide member.

A third solution is described in the patent application US 2010/252210, in which barriers for architectural openings, in particular to a screen apparatus and method for screening off an architectural opening are disclosed. The screen apparatus includes an elongated overhead frame member, a transverse fixed side frame member, a displaceable side frame member, and an elongated articulated bottom frame member. A screen member extends between the frame members, the screen member being interchangeable between a collapsed condition when the screen is open and an extended condition when the screen is closed by movement of the displaceable side frame member.

A fourth solution is described in the patent EP 2487317 concerning a screen device which allows an easy length adjustment work, configured in such a manner that when the size of first rigid units which constitute an upper slide guide frame portion is smaller than the size of second rigid units which constitute a lower slide guide frame portion and the upper slide guide frame portion and the lower slide guide frame portion are retracted in the interior of a screen mounting frame, side wall portions of the first rigid units are fitted in between the side wall portions of the second rigid units, the upper slide guide frame portion intersects the lower slide guide frame portion in the interior of the screen mounting frame, connection of the first rigid units can be released at an arbitrary position in the interior of the screen mounting frame when adjusting the length of the screen device, and the upper slide guide frame portion can be taken out from the screen mounting frame, so that an adjustment of the length in the field of installation is facilitated.

A last solution is described in the patent EP 2400105 concerning a mosquito net which is mobile between a completely open position and a completely closed position for openings comprising arc portions, undercuts, bevelings or similars, comprising a net having a fixed extremity integer to a first portion of a frame delimiting said opening and a mobile extremity associated to a mobile hollow vertical upright slidingly associated to a first guide and housing a rod vertically slidable whose superior extremity is slidingly associated to a second guide and supports a tensioning cable suitable to run inside said mobile upright and inside said second guide until it attaches itself to a compensating spring whose fixed extremity is integer to a second portion of the frame.

However, although functional, these movable foldable guides do not guarantee the seal of the shield under the effect of wind or in case of accidental events, as they can be easily disengaged in such conditions.

SUMMARY

This section provides a general summary of the disclosure, and is not a comprehensive disclosure of its full scope or all of its features.

The aspect of the present invention is to provide a system comprising a sliding shield and a guiding and tensioning retractable device for the sliding shield allowing to stretch the shield and to ensure his estate under the action of wind or accidental events, thus having characteristics that exceed the limits that influence the movable foldable guides previously described.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

For a better understanding of the present invention a preferred embodiment is now described, purely by way of non-limiting example, with reference to the accompanying drawings, in which.

DETAILED DESCRIPTION

Example embodiments will now be described more fully with reference to the accompanying drawings.

Figure 4:
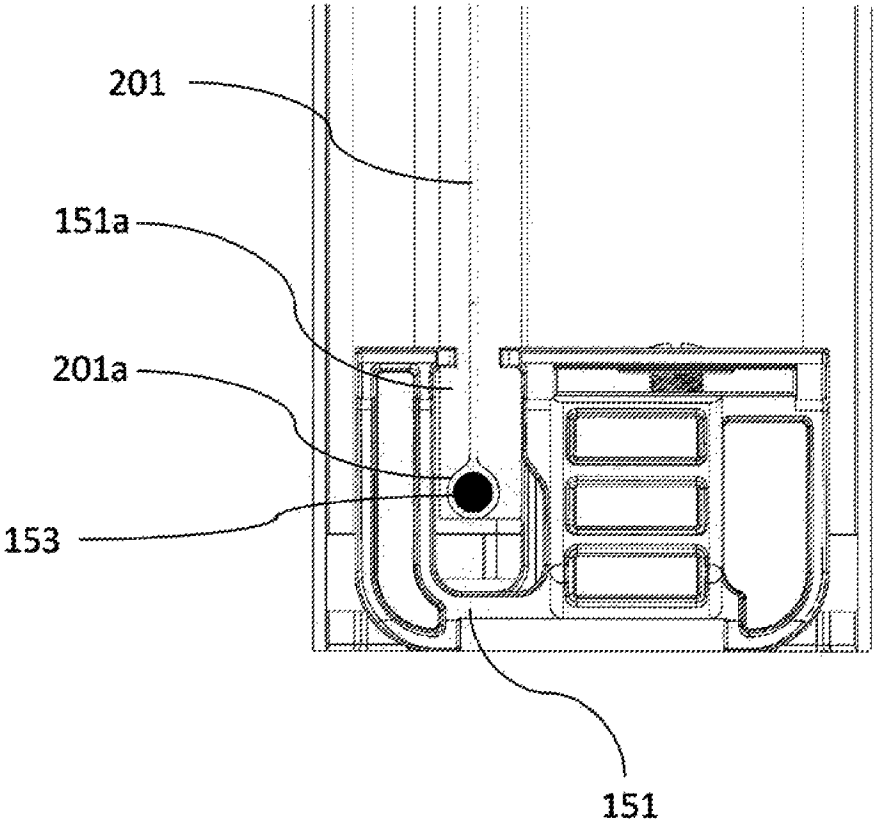
FIG. 4 shows a schematic front view of the system comprising the tensioning element of FIG. 3, according to the invention.

Referring to these figures and, in particular to FIG. 4, a system comprising a sliding shield and a guiding and tensioning retractable device for the sliding shield is shown, according to the invention. In details, the system comprises a sliding shield 200, for example a mosquito net, comprising a cloth 201 sliding horizontally and provided with a lower pocket 201*a*, shown in FIGS. 4 and 5, a closure upright 202, a handle bar 203 with a lower chute 203*a*, shown in FIG. 2, a lateral box 204, a fixed upper guide 205 and a lower fixed guide, not shown in the figures.

Figure 1:
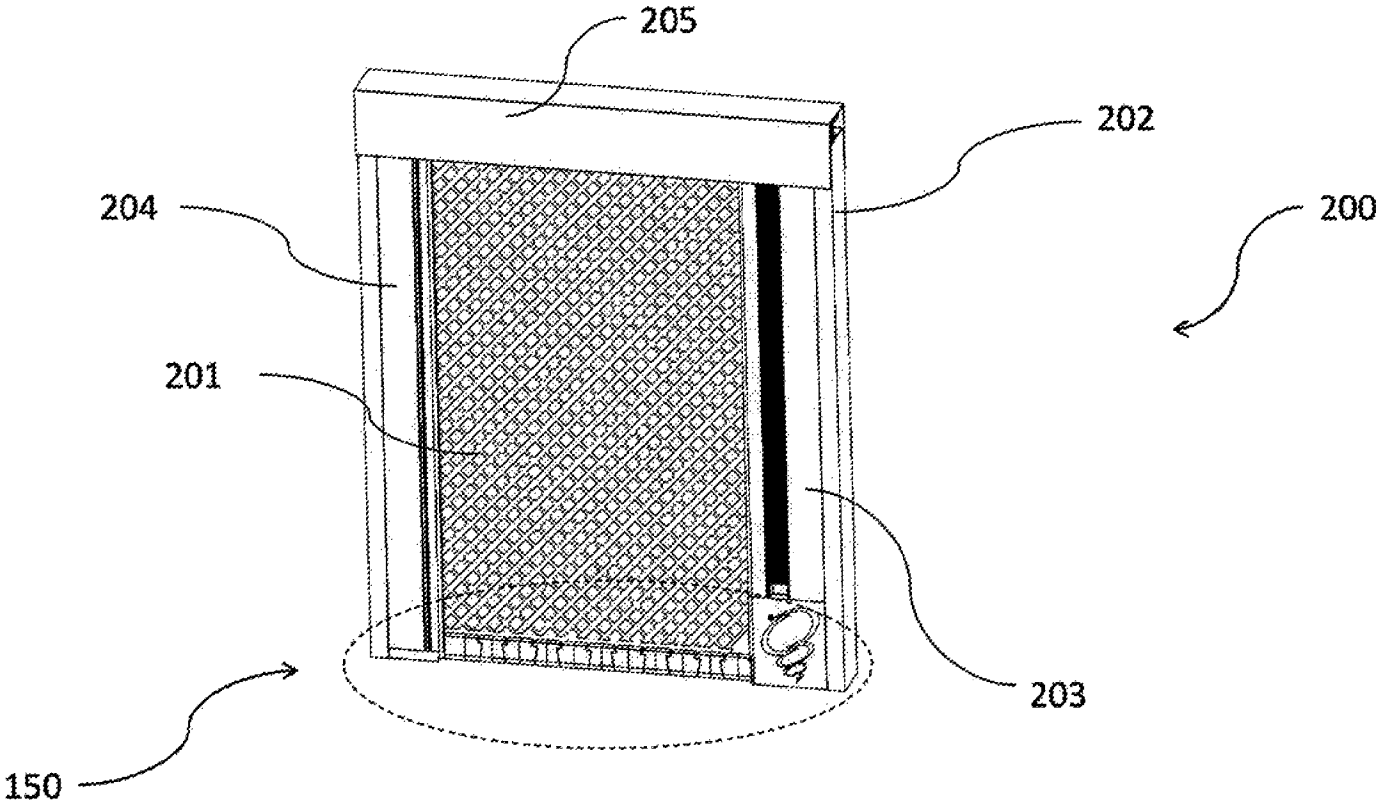
FIG. 1 shows a three-dimensional schematic view of a system comprising a sliding shield and a guiding and tensioning retractable device for the sliding shield, according to the invention.
Figure 2:
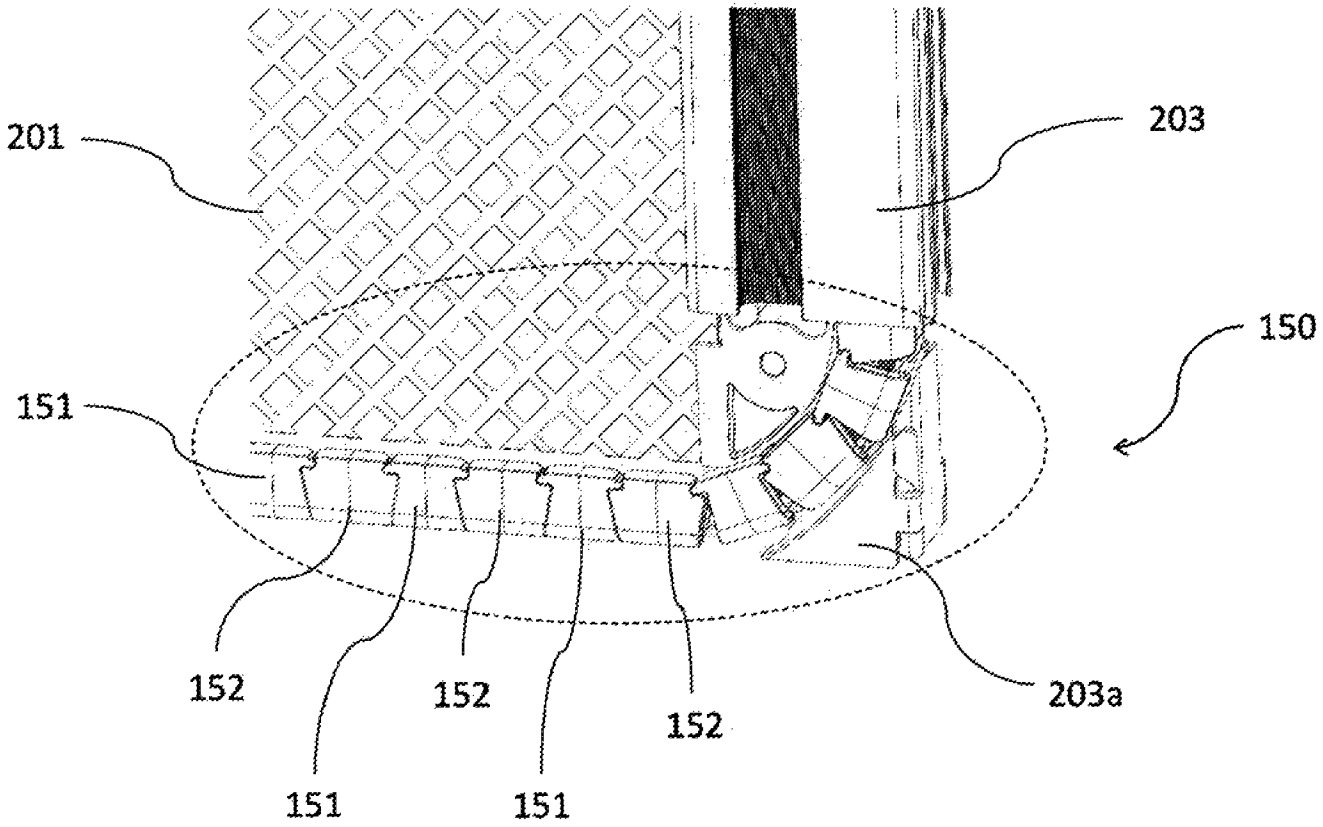
FIG. 2 shows a schematic three-dimensional view of guiding modules of the guiding and tensioning retractable device for the sliding shield, according to the invention.

Moreover, as best shown in FIG. 2, the system comprises the guiding and tensioning retractable device 150 for the sliding shield comprising a plurality of first guiding modules 151 and a plurality of second guiding modules 152, consecutively and alternately coupled to each other to form a single guiding body foldable and insertable inside the handle bar 203 passing through the lower chute 203*a*.

The first guiding modules 151 and the second guiding modules 152, are coupled to each other in an alternating manner, and are interposed between the handle bar 203 and the lateral box 204 at which a first terminal end 151*t'* (FIG. 7) of the single guiding body, is bound. Each one of the first guiding modules 151 includes tabs 160 extending from opposite ends thereof. Each one of the second guiding modules 152 includes recesses that the tabs 160 are seated on for coupling the first guiding modules 151 and the second guiding modules 152 together.

Figure 3:
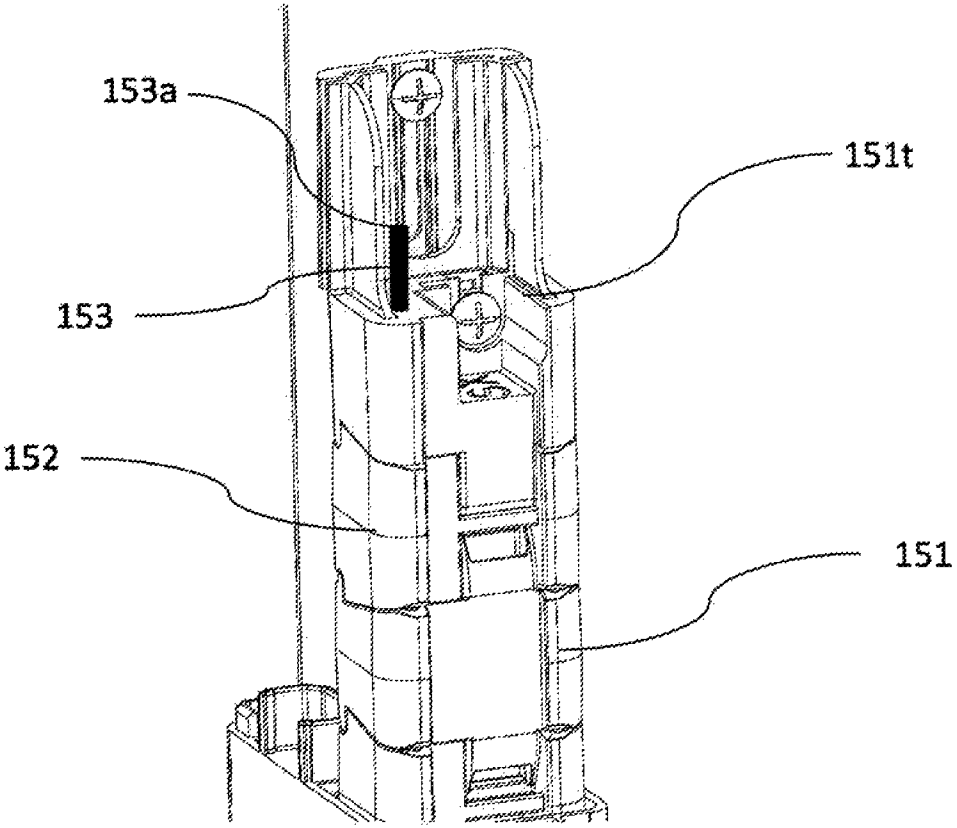
FIG. 3 shows a schematic perspective view of a tensioning element of the guiding and tensioning retractable device for the sliding shield put inside the guiding modules of FIG. 2, according to the invention.

Instead, as shown in FIG. 3, a second terminal end 151*t* of the single guiding body is free to slide inside the handle bar 203. Furthermore, the guiding and tensioning retractable device 150 comprises a tensioning element 153 having a first end 153*a*, which is advantageously still attached to the second terminal end 151*t* of the single guiding body.

Figure 7:
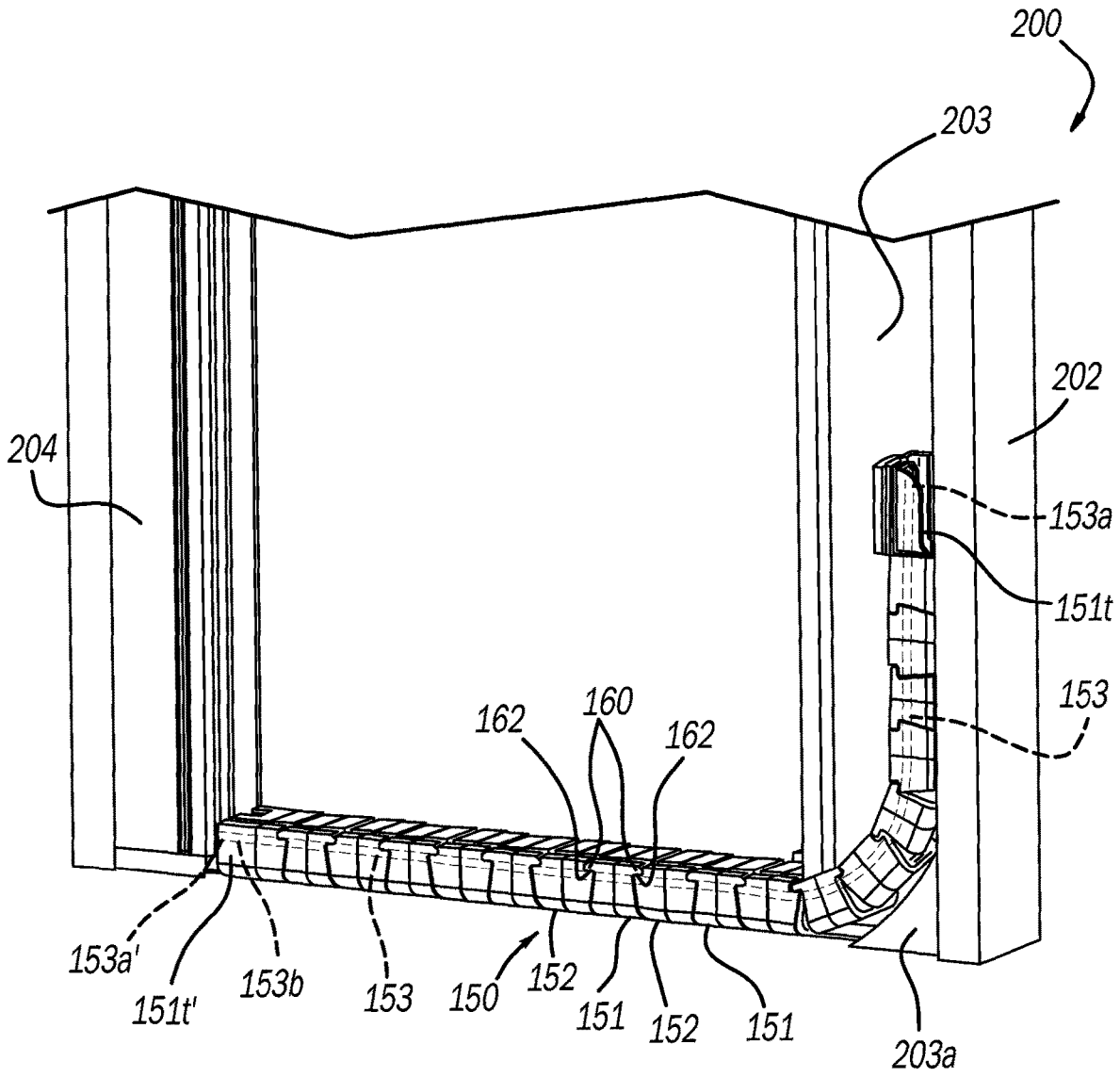
FIG. 7 is a perspective view of the guiding and tensioning retractable device.

According to an aspect of the invention, the tensioning element 153 has a second end 153*a'*, shown in FIG. 7, free and inserted into the lower pocket 201*a* of the shield 200.

According to another aspect of the invention, as shown in FIG. 4, the tensioning element 153 and the lower pocket 201*a* of the cloth 201 are respectively disposed inside first housing 151*a* of the first guiding modules 151 and inside seconds housings, not shown in the figure, of the second guiding modules 152.

Figure 5:
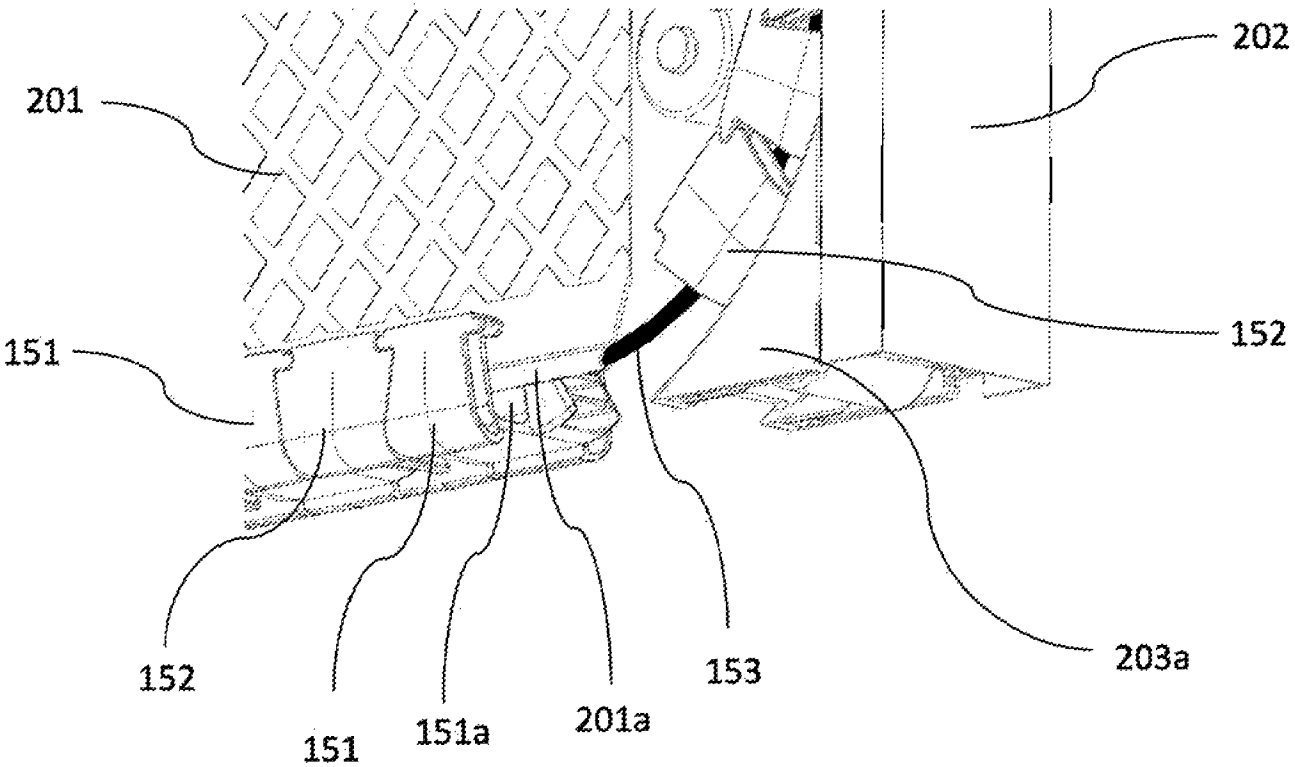
FIG. 5 shows a schematic perspective view of a lower portion of the system comprising a sliding shield and a guiding and tensioning retractable device for the sliding shield, according to the invention.
Figure 6:
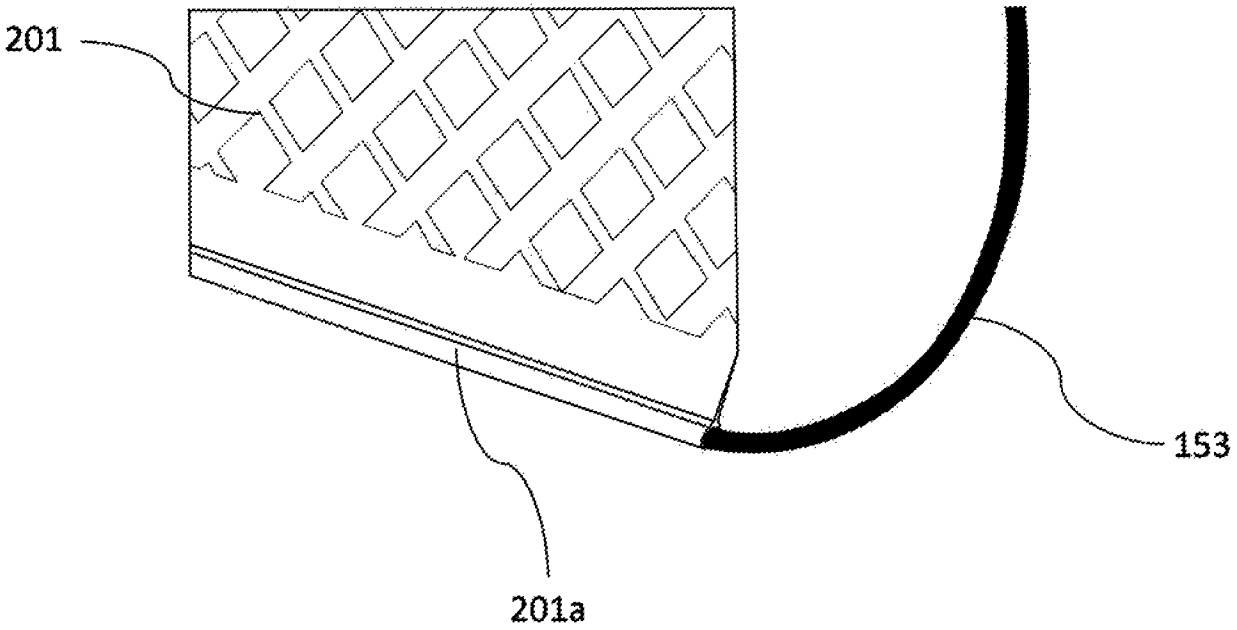
FIG. 6 shows a three-dimensional schematic view of the tensioning element of FIG. 3, according to the invention.

Advantageously according to the invention, during the opening of the shield 200 by means of the handle bar 203, the device 150 outgoing from the handle bar 203 drags the tensioning element 153 forcing it to slide inside the lower pocket 201*a* of the shield 200, as best shown in FIGS. 5 and 6. In this way, as a result of the insertion of the tensioning element 153 within the lower pocket 201*a*, the cloth 201 is locked within the first housings 151*a* of the first guiding modules 151 and within the second housings of the second guiding modules 152.

Advantageously according to the invention, the tensioning element 153 tensions automatically the cloth 201 of the shield and keeps it extended.

According to an aspect of the invention, the tensioning element 153 is of metallic material.

According to another aspect of the invention, the tensioning element 153 is of plastic material.

According to another aspect of the invention, the first guiding modules 151 and the second guiding modules 152 are of plastic material.

According to another aspect of the invention, the tensioning element 153 is a rod.

Therefore, the system comprising a sliding shield and a guiding and tensioning retractable device for the sliding shield according to the invention allows that the cloth always remains anchored to it even under the action of the wind.

Another advantage of the system comprising a sliding shield and a guiding and tensioning retractable device for the sliding shield according to the invention consists in the fact that blocking the cloth on it avoids the formation of folds at the perimeter and consequently the entry of insects.

Another advantage of the system comprising a sliding shield and a guiding and tensioning retractable device for the sliding shield according to the invention is the simplicity of construction.

Another advantage of the system comprising a sliding shield and a guiding and tensioning retractable device for the sliding shield according to the invention is that it takes up only minimal space.

A further advantage of the system comprising a sliding shield and a guiding and tensioning retractable device for the sliding shield according to the invention consists in the fact of being economic.

Finally, it is clear that the system comprising a sliding shield and a guiding and tensioning retractable device for the sliding shield described and illustrated here can be modified and varied without thereby abandoning the scope of the present invention, as defined in the appended claims.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A system comprising:

a sliding shield equipped with horizontally sliding cloth movable by means of a handle bar between a lateral box and a closure upright, and a guiding and tensioning retractable device for the sliding shield including a plurality of first guiding modules and a plurality of second guiding modules coupled together in an alternating manner such that one of the plurality of first guiding modules is between two of the plurality of second guiding modules and one of the plurality of second guiding modules is between two of the plurality of first guiding modules, the plurality of first guiding modules and the plurality of second guiding modules together form a guiding body that is foldable and is insertable within the handle bar, the guiding body including a first terminal end fixable to the lateral box and a second terminal end slidable within the handle bar, the first guiding modules and the second guiding modules being interposable between the handle bar and the lateral box;

wherein each one of the first guiding modules includes tabs at opposite ends thereof, and each one of the second guiding modules includes recesses at opposite ends thereof, each one of the tabs sits on one of the recesses;

wherein the sliding shield includes at least a lower pocket; and wherein the guiding and tensioning retractable device includes comprises at least a tensioning element extending through the lower pocket, a first end of the tensioning element is anchored to the second terminal end and a second end is inserted within the lower pocket, wherein the second end is configured to slide within the lower pocket.

2. The system according to claim 1, wherein the tensioning element is arranged within first housings of the first guiding modules and the lower pocket is arranged within second housings of the second guiding modules.

3. The system according to claim 1, wherein the tensioning element is made of metallic material.

4. The system according to claim 1, wherein the tensioning element is made of plastic material.

5. The system according to claim 1, wherein the tensioning element is a rod.

* * * * *